United States Patent [19]

Wiley

[11] Patent Number: 4,923,124

[45] **Date of Patent: * May 8, 1990**

[54] METHOD OF PNEUMATIC COMMINUTION

[75] Inventor: Allen C. Wiley, Coralville, Iowa

[73] Assignee: Microfuel Corporation, Coralville, Iowa

[ * ] Notice: The portion of the term of this patent subsequent to Apr. 11, 2006 has been disclaimed.

[21] Appl. No.: 244,643

[22] Filed: Sep. 13, 1988

Related U.S. Application Data

[63] Continuation of Ser. No. 697,042, Jan. 31, 1985, abandoned.

[51] Int. Cl.[5] ..... B02C 19/00

[52] U.S. Cl. ..... 241/5; 241/18

[58] Field of Search ..... 241/1, 5, 18, 26, 39, 241/40, 275; 415/170 A

[56] References Cited

U.S. PATENT DOCUMENTS

| | | | |
|---|---|---|---|
| 416,070 | 11/1909 | Pelzer . | |
| 1,019,385 | 3/1912 | Warg . | |
| 1,090,073 | 3/1914 | Kieser | 415/170 A |
| 1,320,079 | 10/1919 | MacGregor . | |
| 1,697,202 | 1/1929 | Nagle . | |
| 1,959,703 | 5/1934 | Birhmann . | |
| 2,265,758 | 12/1941 | Klosson | 103/111 |
| 2,386,401 | 10/1945 | Joyce, Jr. | 19/1 |
| 2,605,800 | 8/1952 | Mateu | 146/107 |
| 2,675,967 | 4/1954 | Mote | 241/47 |
| 2,765,748 | 10/1956 | Buchi . | |
| 2,778,577 | 1/1957 | Linke | 241/47 |
| 2,784,936 | 3/1957 | Schmidt . | |
| 2,823,868 | 2/1958 | Scherer | 241/2 |
| 2,848,029 | 8/1958 | West | 146/107 |
| 2,851,289 | 9/1958 | Pedersen | 415/170 A |
| 2,910,250 | 10/1959 | Fisher | 241/101 |
| 2,973,894 | 3/1961 | Kimball et al. . | |
| 3,096,718 | 7/1963 | Anderson | 103/111 |
| 3,206,807 | 9/1965 | Hoffman et al. . | |
| 3,255,793 | 6/1966 | Clute | 146/1 |
| 3,260,443 | 7/1966 | Garnett et al. . | |
| 3,362,338 | 1/1968 | Stethem . | |
| 3,381,621 | 5/1968 | Luhmann et al. . | |
| 3,381,901 | 5/1968 | Foch . | |
| 3,405,913 | 10/1968 | Chatfield et al. | 415/170 A X |
| 3,425,638 | 2/1969 | Doyle et al. . | |
| 3,510,230 | 5/1970 | Raub | 415/170 A |
| 3,675,858 | 7/1972 | Stephanoff . | |
| 3,973,733 | 8/1976 | Switzer . | |
| 3,973,872 | 8/1976 | Selznev et al. . | |
| 4,018,544 | 4/1977 | Eberhardt | 415/170 A |
| 4,023,918 | 5/1977 | Stahl | 415/170 A X |
| 4,108,572 | 8/1978 | Platt . | |

(List continued on next page.)

FOREIGN PATENT DOCUMENTS

| | | | |
|---|---|---|---|
| 269616 | 1/1914 | Fed. Rep. of Germany . | |
| 138087 | 2/1930 | Fed. Rep. of Germany | 415/170 A |
| 63233 | 7/1982 | Fed. Rep. of Germany . | |
| 886983 | 12/1981 | U.S.S.R. | 241/1 |
| 464449 | 4/1937 | United Kingdom . | |
| 598594 | 2/1948 | United Kingdom | 241/1 |

*Primary Examiner*—Joseph M. Gorski

*Attorney, Agent, or Firm*—Hill, Van Santen, Steadman & Simpson

[57] ABSTRACT

An improved centrifugal pneumatic comminutor including a housing containing a fan means operatively connected to a motor means, said housing having an inlet opening aligned with the axis of said fan and an outlet opening on the perimeter of said housing, an input conduit mounted to said housing surrounding said inlet opening including a frustal conically shaped section adjacent said housing, and an output conduit attached to said housing surrounding said outlet opening, the material to be comminuted being introduced into said input conduit and being drawn into said frustal conically shaped section by suction of said fan. The materials are comminuted in said iput conduit in a rotational impact area directly below said fan and thereafter are pulled through said fan and forced out said output conduit by the pressure of said fan. The fan means includes a ring member attached to the fan which rotatably mates with a journal means attached to the housing creating an air lock through the comminutor.

1 Claim, 2 Drawing Sheets

U.S. PATENT DOCUMENTS 4,109,688 4/1978 Akunov et al. .
4,131,239 12/1978 Stephanoff .
4,167,369 9/1979 Isihara .
4,189,102 2/1980 Andrews .
4,219,164 8/1980 Taylor .
4,243,233 1/1981 Arai ..... 415/170 A
4,245,952 1/1981 Eberhardt ..... 415/170 A
4,248,387 2/1981 Andrews .
4,288,166 9/1981 Nakabayashi et al. .
4,318,672 3/1982 Hansen .
4,364,712 12/1982 Charles .
4,381,171 4/1983 Chapple .
4,390,131 6/1983 Pickrel ..... 241/1
4,391,411 7/1983 Colburn ..... 241/1
4,418,871 12/1983 Powell .
4,520,541 6/1985 Miki et al. .
4,538,764 9/1985 Dunbar .
4,634,344 1/1987 Zagar et al. .
4,653,976 3/1987 Blair et al. .
4,659,288 4/1987 Clark et al. .
4,671,740 6/1987 Ormiston et al. .

7-7

METHOD OF PNEUMATIC COMMINUTION

This is a continuation of application Ser. No. 06/697,042, filed 1/31/85, and now abandoned.

BACKGROUND OF THE INVENTION

1. Field of the Invention

This invention relates to a means and method of comminuting materials, in particular, a means and method of pneumatically comminuting various materials.

2. Problems in the Art

Comminution, the pulverization or breaking apart of materials into small parts, is a significant operation in many industries, particularly the coal and cement industries which require tremendous amounts of crushing and grinding. However, current comminution technology used by industry is both energy intensive and inefficient. Annual electrical energy consumption in size reduction operations by U.S. industry is approximately 32 billion kilowatt hours (KWH). More than half of this energy is consumed in the crushing and grinding of minerals. An additional 3.7 billion KWH per annum is contained in energy inconsumables, such as grinding media and liners. The total amount of energy approaches 2% of the national electric power production.

The amount of energy used by U.S. industry to produce its products not only contributes to that cost of production, but also is a factor in the end product's marketability on world markets. A study of U.S. industries reveals that the cost of a commodity intended for both national and international markets is closely associated with the cost of energy required to manufacture that commodity. These energy costs are particularly high in the primary metals, chemical, food, paper and petroleum industries. All of these industries rely heavily upon particle size reduction operations, which is therefore a significant contribution to product cost. It can therefore be seen that there exists a continuing need for improvements in comminutors, and energy consumption in the comminution process. Two vivid examples are the coal and cement industries.

It is well known that using coal as an energy source presents several barriers preventing its widespread use. Among these are derating of a boiler burning natural gas or oil, more elaborate handling and combustion facilities, and expensive pollution control. Investigations concerned with coal combustion and pollution control show promise of removing these barriers without significant cost increases. Thus, the price of coal should remain favorable and yield widespread usage of coal.

It is known in the art that micronized coal burns more efficiently than lump coal. Micronized coal is lump coal which is disintegrated to micron sized particles. Micronized coal also provides for easier handling, more efficient, complete and controllable combustion, and an opportunity to reduce particulate emissions.

A micronized coal particle has a larger surface per unit volume, thereby increasing the burning rate. Micronized coal burns much like a No. 2 oil, suggesting that retrofitting can be accomplished by replacement of the oil or gas burner with a coal burner, and derating of a furnace is unnecessary. Further development of techniques for combustion systems using micronized coal and applications of these techniques to industrial size furnaces is in process.

It is interesting to note that studies have shown that the critical pollution problem involved with the sulfur content in coal can be controlled or eliminated by injecting limestone into the coal during the combustion process. The calcium reacts with the sulfur to produce calcium sulfate particles which are removed with the ash, using conventional particle gas separators. To facilitate injection of the limestone, it too must be micronized. The combined micronized limestone and coal represents a viable method of reducing both energy costs, through use of coal, and sulfur dioxide pollutants by the sulfur calcium reaction. There is therefore a continuing need for an apparatus which will allow efficient and economical coal micronization.

Micronized coal of the size between 5 micrometers ($\mu$m) and 30 $\mu$m is more advantageous than the particles produced by conventional pulverizers where particle sizes range from 50 to 150 $\mu$m. The centrifugal comminutor of this invention will efficiently and economically produce coal particles between 5 $\mu$m and 30 $\mu$m in diameter.

A second major advantageous use for comminution exists in the cement industry. In the cement industry, the surface area per unit weight has become a standard for characterizing cement quality. Acceptable fineness is around 3,200 to 4,200 $cm^2$ per gram ($cm^2/gm$) of cement. This measurement, known as Blaine Surface Measurement, is made by measuring the pressure drop which results from the flow of air through a standard packed bed of cement.

Recent studies have shown that the particle size of cement is important, based upon the following findings: (1) by controlling the cement particle size to below 20 $\mu$m, with a Blaine area of only 2600 $cm^2/gm$, strengths equaling that of normally ground cements of 3600 $cm^2/gm$ Blaine area can be achieved; (2) The amount of ground clinker in a 2.5 $\mu$m particle size range has large effects on bleeding, water requirements for flow, and strength of development; (3) Controlled product particle size of cement grinding results in cements of as high or higher strengths at ages from 1–60 days at Blaine areas of 450–800 $cm^2/gm$, substantially lower than the normal grinds of the same composition.

It is estimated that the adoption of particle size control in clinker grinding by the entire United States cement industry would result in a 27% saving in grinding energy, and an 8.5% savings in kiln fuel. To achieve such control, however, reliable on-line (real time) particle size and specific surface measurement devices need to be developed. The centrifugal comminutor of this invention can be successfully used in the cement industry.

It is generally believed that high specific surface areas produce high strength cement. The actual particle size distributions also influence cement strength. The particle sizes that have the greatest effect of cement strength are 5 to 30 $\mu$m.

By comminuting the elements of cement, namely, limestone and clinker in the comminutor of this invention, improvements in cement quality and savings in energy consumed in producing cement can be achieved.

In other areas too, besides coal and cement, a tremendous energy savings could be realized by reducing energy consumption for other comminuted products.

For example, comminution is utilized on a significant scale for many other commodities including, but not limited to, the following: aluminum, arsenic, asbestos, barite, boron, calcium, ceramics, chromium, clays, copper, diatomite, feldspar, fluorspar, golds, grain, gypsum, iron ore, lead, lithium, magnesium, manganese, mercury, mica, molybdenum, nickel, perlite, phosphate, potassium, pumice, rare earth, sand and gravel, salts, silicon, silver, a stone, chalk, titanium, tungsten, uranium, vermiculite, and zinc. It is estimated that the energy used for comminution of these materials approaches 30 billion kilowatt hours per year.

Existing technology utilizes such apparatuses as ball mills, rod mills, roll mills, autogenous mills, and hammer mills as fine grinders; and attrition and fluid energy mills as ultrafine grinders. The tremendous cost of these devices centers not only on their operating energy consumption, but also on their capital costs, maintenance, metal loss from attrition of moving parts with the material being comminuted, and ancillary equipment which is needed to operate in conjunction with these devices.

The present invention represents a significant improvement over the above mentioned conventional comminutors as it utilizes pneumatics and particle-to-particle attrition for both transport of the material and comminution of the material, respectively.

Pneumatic or vacuum comminution, was the subject of U.S. Pat. No. 3,255,793, issued to Clute on June 14, 1966. Clute utilized pneumatic comminution for crop grinding. Clute used a vertically rotating fan in a housing having an horizontal inlet along the fan axis. However, Clute neither encountered nor contemplated the use of this device for coal comminution or cement industry applications nor was the Clute device successful in its intended use. Furthermore, it has been found that Clute's invention was and is not successful because of problems with the pneumatics and because of excessive and unacceptable metal loss from the blades of fans. The device of this invention accomplishes much smaller size reduction than Clute when comparable energy is expended.

In the centrifugal action of the present improved comminutor, its non-uniform acceleration of various massed particles, causes particle-to-particle attrition of the material in the area directly before the fan. Thus, comminution is achieved substantially prior to the particles passing through the rotary fan. As a result, metal wear is lessened considerably.

SUMMARY OF THE INVENTION

The present invention provides a means and method of significantly economizing energy use and capital costs associated with comminution technology, while at the same time providing accurate and uniform-in-size comminution, with minimal metal loss to the comminuting device.

These advances over Clute are possible by virtue of the improved structure and methods of this invention. Improvements in the structure include inter alia modification of the fan structure and its association with the fan housing, horizontal placement and rotation of the fan, variations in the dimensions and relationship of the cone leading into the fan housing with fan size and speed; and tailoring of the structure and method to enhance performance with minerals and other products.

The present invention includes a fan means rotatably connected to a power source and enclosed within a fan housing. The axle of the fan extends upwardly through the top surface of the housing, whereas an opening concentrically aligned with the fan axis exists on the lower surface of the housing. An outlet opening is provided along the perimeter of the fan housing.

The lowermost portion of the fan has a ring member including a flange means which is mateable in close proximity with the flange means of a journaling means mounted surrounding the inlet opening to the fan housing. The ring member and journaling means combination assures a sealed and efficient air flow through the device by creating an air lock between the inlet, the fan housing and the outlet.

The method of the present invention utilizes various structural relationships to provide an improved method of comminution within the device. For example, the fan speed is variably adjustable in accordance with the throughput and is directly related to particle size output. Fan size and blade shape is related to the input cone size and shape to achieve a desired air flow and particle size. The step of providing an air lock by way of the ring and journal means improves the air flow through the device, to achieve better particle-to-particle attribution.

The results of the improved structure and method of the present invention provide uniformity-in-size of comminuted particles which is accurately controllable, while at the same time minimizing or eliminating any metal loss from the blades of the fan. Moreover, the means and method of the present invention allow it to be effectively operative for many different types of materials with the same results, from very hard minerals such as granite, iron ore, chromium and mica, to soft materials such as grain, clay, and the like.

The present invention also presents the advantages of significant economy in energy consumption per product comminuted, and significant savings in capital equipment costs, for the comminutor itself by eliminating the need for most ancillary equipment. It can be operatively implemented into micronized coal combustion systems, cement grinding operations, and a multitude of other applications.

It is therefore a primary object of the invention to improve over the problems and upon the deficiencies in the art of comminutors.

A further object of the invention is to provide a means and method for comminuting materials which does so efficiently and effectively.

A further object of the invention is to provide a means and method of comminuting materials which produces uniform-in-size output particles.

Another object of the invention is to provide a means and method of comminuting materials which experiences little or no metal loss in the comminutor.

Another object of the invention is to provide a blade means and method of comminuting materials which produces effective suction or vacuum and creates an effective comminuting environment which combines the effects of reduced environment pressure and centrifugal force in combination with a pulsating turbulence zone just in front of the fan blade tips.

A further object of the invention is to provide a means and method of comminuting materials which provides an effective air lock throughout the device.

A further object of the invention is to provide a means and method of comminuting material which is variable in adjustment of air flow speed which as a result allows selection of particle size output.

Another object of the invention is to provide a means and method of comminuting materials which can be used for many different applications, from hard materials to soft materials.

These and other objects, features, and advantages of the invention will become apparent with reference to the accompanying specification and claims.

DETAILED DESCRIPTION OF THE PREFERRED EMBODIMENTS OF THE INVENTION

Figure 1:
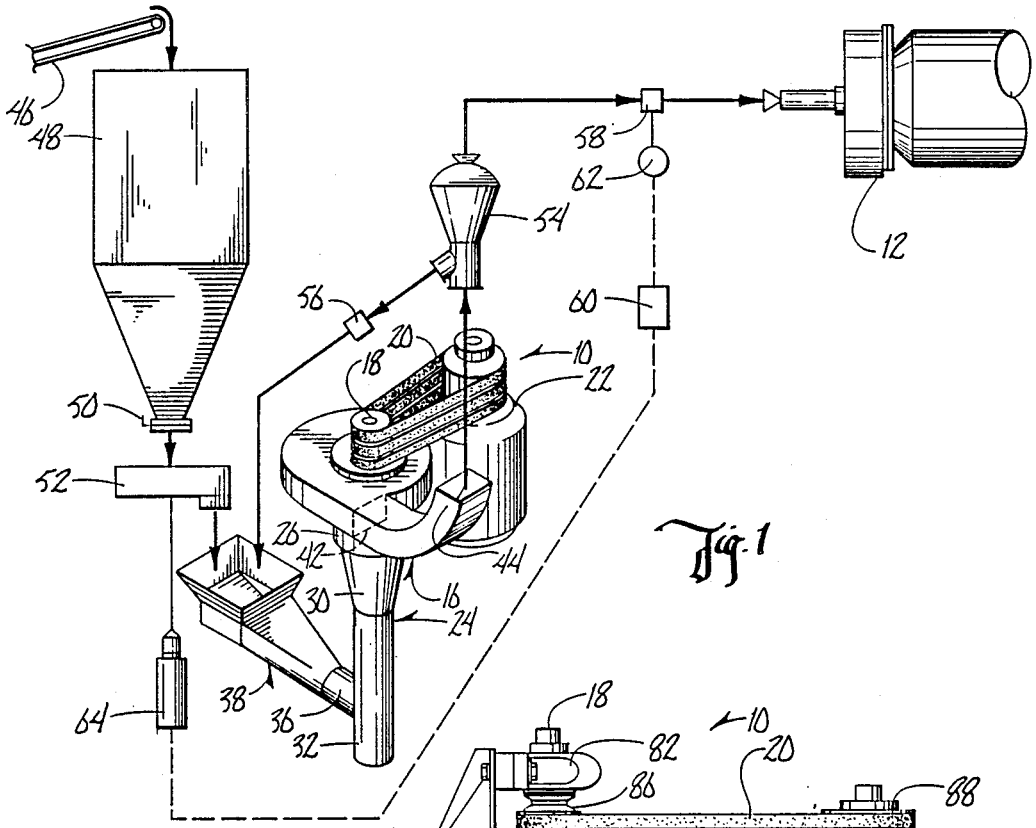
FIG. 1 is a partial elevational view, partial perspective view, and partial schematic view of the invention.

By referring to the drawings, the preferred embodiments of the invention are now described in detail. The invention is useful in different comminution operations, but is illustrated with micronized coal. The basic operation and method is the same for all applications, only the supporting components differ. The speed of the fan and the dimension of the components such as the cone shape of the chamber could differ as to varying applications. For example, a multi-stage device would comminute to a given particle size without external classification.

FIG. 1 depicts the comminutor 10 schematically in association with ancillary supporting components for micronizing coal and introducing it into a coal furnace 12.

The basic comminutor 10 consists of a fan 14 (see FIG. 2) contained within a housing 16. Fan 14 is rotatable within housing 16 by operative connection of axle 18 via belts 20 to a motor 22. Belts 20 enhance safety of the invention by providing slippage in the event of any jamming of fan 14. An input conduit 24 is comprised of an annular section 26 attached to the bottom of said housing surrounding an inlet opening 28 (see FIG. 2), a conical section 30 and tubular section 32 having a side opening 34 therein. Side tube 36 is attached to tubular section 32 around side opening 34 and in turn, at its outer end, is put into communication with hopper 38 having a feeder gate 40.

Fan housing 16 has an outlet opening 42 along the perimetric edge of housing 16 to which is connected an outlet conduit 44.

By operating motor 22 to rotate fan 14, a partial vacuum is produced in input conduit 24. By introducing the material to be comminuted into hopper 38, which controllably channels the material into tubular section 32 through side tube 36, the partial vacuum in input conduit 24 causes most of the material to be suctioned into conical section 30 where, because of the shape of conical section 30, the material is caused to assume a centrifugal, upward spiraling path. At a point in front of the fan blade tips (the rotational impact zone), the difference in mass of the various pieces of material causes some to accelerate faster than the others, and as a result causes particle-to-particle attrition to take place. Because the centrifugal motion is at a maximum in annular section 26 (the rotational impact zone), at a level nearest fan 14, the greatest amount of attrition occurs at that location, i.e., just prior to fan entry.

Attrition continues until the material is comminuted to a minute size at which point the uniform-in-size comminuted particles are suctioned into fan housing 16 and pushed by the positive air pressure on the back side of fan 14 out of outlet conduit 44 for the desired use. In FIG. 1, since the desired use consists of micronizing coal, the micronized particles are directed into the coal furnace or kiln 12. A conveyor 46 deposits lump coal into bin 48 which, by operation of gate 50, allows the lump coal to pass to disc feeder 52 which feeds the coal into hopper 38.

At the output end of the system of FIG. 1, a twin-cone classifier 54 is connected to outlet conduit 44 and serves to reject non-uniform size coal particles or otherwise unacceptable particles and rechannels them through air lock 56 into hopper 38. The pressure from fan 14 provides the force to move the micronized coal to classifier 54 and then to damper 58, which controls the amount of micronized coal going into furnace or kiln 12.

Control of both lump coal entering comminutor 10 and micronized coal entering furnace or kiln 12 is accomplished by coal rate controller 60 which is electronically connected to damper actuator 62 on the one hand, and a semi-conductor controlled rectifier (SCR) 64 which controls the rate of disk feeder 52 on the other hand. Coal rate controller 60 can be a computerized mechanism having sensors of rates of flow which can compare said rates to predetermined values for furnace 12 output, and, of course, can consist of manual controls. Such coal rate controllers are known in the art.

Figure 2:
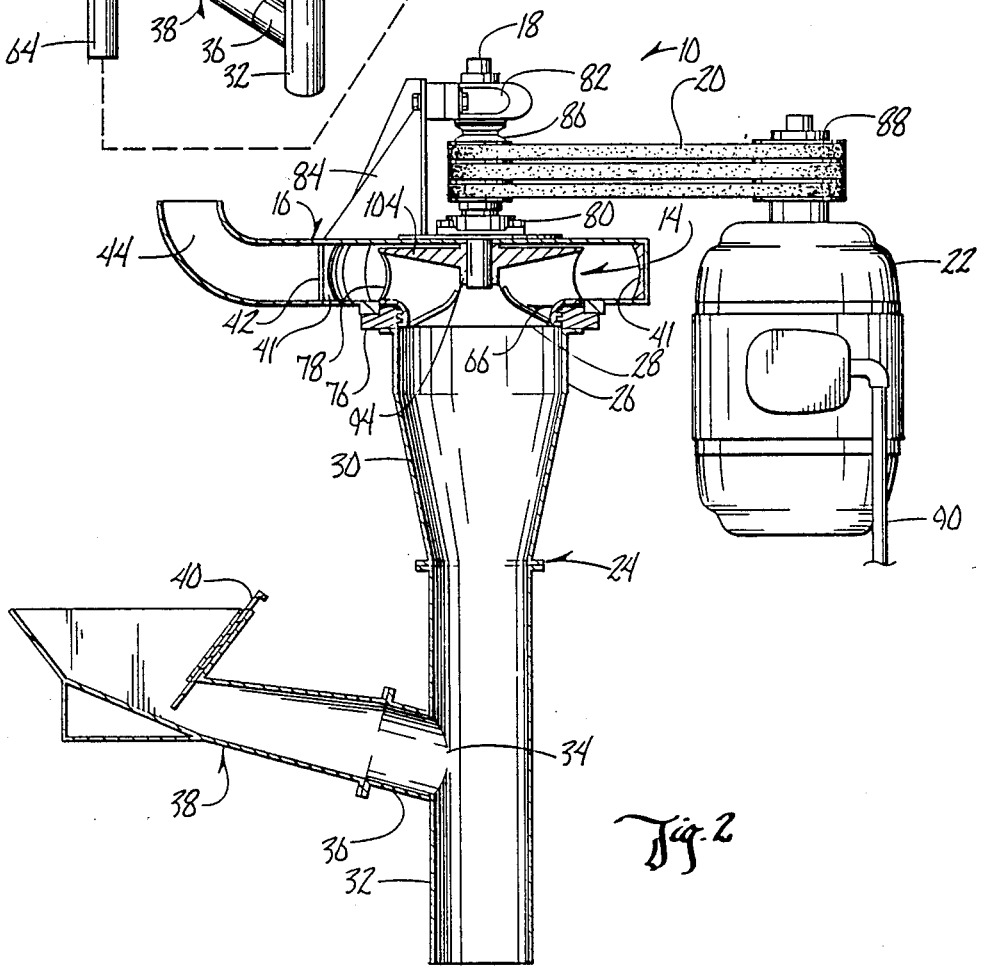
FIG. 2 is an elevational view with the fan, housing and conduits in section.

The exact structure of comminutor 10 is more clearly seen in FIG. 2. Fan 14 is removably secured to axle 18 within housing 16. Importantly, an effective air lock is accomplished throughout the system, and particularly between input conduit 24, housing 16, and output conduit 44, by a ring means 66 secured annularly to the bottom of fan 14. Ring means 66 has a flange means consisting of annular rings 70 (see FIG. 4) which are mateable with flange means or rings 74 (see FIG. 4) of a journal means 76 which is secured around the inlet opening 28 on the bottom surface of housing 16. This arrangement forces all materials to pass between blades or vanes 78 of fan 14 and in conjunction with the air pressure relationships within the comminutor creates an effective air lock throughout the system. The ring and journal means also provides for retention of the bottom portion of the fan for stability and accurate positioning although a gap of approximately one-eighth inch exists therebetween. It is to be understood that the air lock gets stronger as fan speed increases because of a corresponding increase in pressure differential above and below fan 14.

Axle 18 is itself journaled within two bearings, the first bearing 80 being secured to the top surface of housing 16, the second bearing 82 extending from supports 84 which in turn is attached to housing 16.

A pulley 86 is rigidly secured to axle 18 between first and second bearings 80 and 82 and is frictionally rotated by belts 20 which are attached to drive wheel 88 of electric motor 22 which is connected to an electrical power source (not shown) by electrical conduit 90.

In the preferred embodiment, journal means 76 is comprised of two semi-circular parts, both semi-circular parts being attached to housing 16 by bolts 92 (three bolts per semi-circular part). The two piece construction of journal means 76 allows journal means 76 to be removed from mating engagement with ring means 66 of fan 14 to allow removal and maintenance to fan 14. The attachment of input conduit 24 to journal means 76, and tubular section 32 to conical section 30 of input conduit 24, and hopper 38 to side tube 36 can be accomplished by methods known within the art, and usually can be accomplished by some sort of bolt means or other removable fastening means. It is to be understood that journal means 76 could also be comprised of three or more parts.

Figures 3, 4, 5, 6, 7:
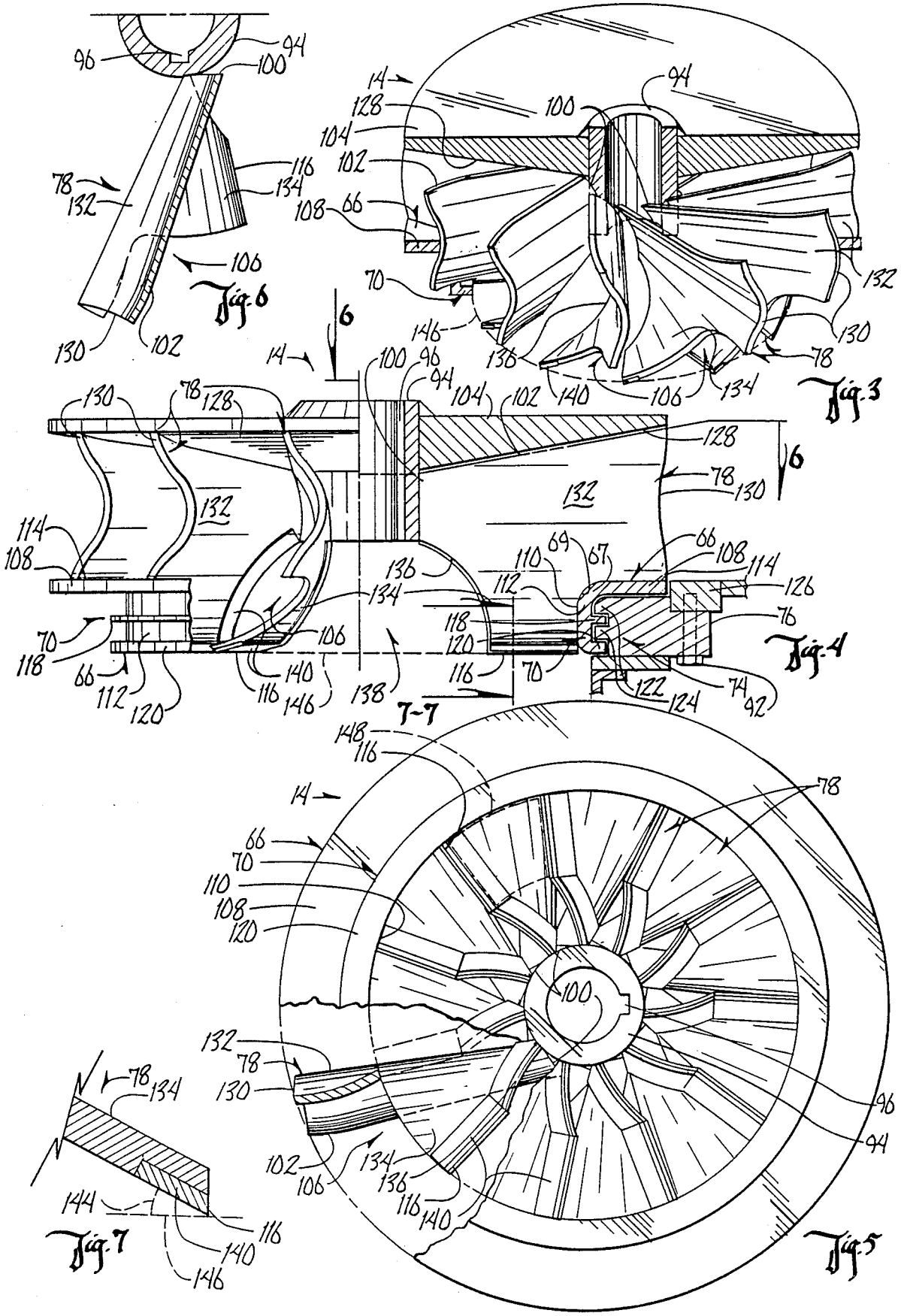
FIG. 3 is a partial sectional view of the fan.
FIG. 4 is a partial elevational view and partial sectional view of the fan.
FIG. 5 is a bottom view of the fan with a broken away portion.
FIG. 6 is a partial sectional top view of a fan blade of the invention taken along lines 6—6 of FIG. 4.
FIG. 7 is a partial sectional view of a fan blade tip of the invention taken along lines 7—7 of FIG. 4.

By referring to FIGS. 3, 4 and 5, the exact structure and conjoint relationship of fan 14 with ring means 66 can be more clearly seen. FIG. 3 illustrates the shape and association of the preferred fan blades or vanes 78. The center of the fan is comprised of a sleeve 94 having a key slot 96 extending its longitudinal length for matable matching of a key 98 (not shown) on axle 18. Blades 78 are attached to sleeve 94 at their innermost ends 100, and are attached at their upper edges 102 to plate 104. By referring concurrently to FIG. 4, it can be seen that ring means 66 is secured in the L-shaped cut-out portions of the lower parts of blades 78. Ring means 66 consists basically of a ring shaped member 108 secured to the vertical edge 110 of L-shaped cutouts 106 of blades 78, and an annular ring 112 attached to ring shaped member 108 and the horizontal edge of L-shaped cutouts 106 of blades 78 extending to the lowermost edge 116 of blades 78. In the preferred embodiment, a middle ring 118 and a bottom ring 120 comprise the ring means 66 described above.

Correspondingly, journal means 76 includes a top ring 122 and a middle ring 124 which matingly position between middle ring 118 and bottom ring 120 of ring means 66 to provide a journaling and retententive relationship for ring means 66 to housing 16. Journal means 76 is secured to a supporting piece 126 which is rigidly attached to housing 16 by bolts 92, and as discussed above, journal means 76 is split into two semi-circular parts (not shown) so that by removing bolts 92, journal means 76 can be split apart, thus allowing access to and maintenance capabilities to fan 14. It is worthy of mention that the farthest width of fan 14 does not extend as far as supporting ring 126, thus allowing removal of fan 14 through inlet opening 28. It can also be seen that annular section 26 of input conduit 24 can be removably attached to supporting piece 126, or can be rigidly secured thereto. The methods and manner of securement of the various components can be as is sufficient and as is known in the art.

FIGS. 3 and 4 illustrate that the lower surface 128 of plate 104 is of increasing thickness from its perimetric edge to its point of attachment with sleeve 94. Therefore, the upper edges 102 of blades 78 are correspondingly sloped e.g., 10° downward. This solid back with an inward taper improves air flow.

It can also be seen from FIGS. 3 and 4 that the plate 104 and ring means 66 essentially sandwich and provide upper and lower boundaries and stress bearing members for fan 14, whereas blades 78 extend essentially between plate 104 and the lower edge of ring means 66.

The major portion of blades 78, as can be seen in FIG. 4, consists of the portion extending from the points of attachment with sleeve 94 outward to outer end 130. For purposes of the description, this will be referred to as upper blade portion 132. An additional part of blade 78 extends downwardly from this upper blade portion 132 and has a lowermost edge 116 and an outermost edge (vertical edge 110) attached to annular ring 112 of ring means 66. For reference, this will be referred to as lower blade portion 134. It should be noted that the inner edge of lower blade portion 134 consists of curved edge 136 which creates a substantial open area 138 below sleeve 94 in the interior of housing 16, directly adjacent to and above inlet opening 28. However, the lowermost edges 116 of lower blade portions 134 of blades 78 extend inwardly from journal means 76 in inlet opening 28. A hard, durable material such as tungsten carbide piece 140 is secured behind and along lowermost edge 116 and curved edges 136 to create a thickened hammer edge. These carbide pieces 140 are easily replaceable, and enhance the grinding action.

FIGS. 3 and 4 also illustrate the concaval shape of the forward faces of blades 78. Additional features characterize blades 78. First, the very outer portion of upper blade portion 132 of each of blades 78 is bent slightly backwards from the direction of travel. Whereas the invention operates adequately with the outer portion of upper blade portion 132 extending in alignment with the entire upper blade portion 132, it has been found that abrasion can carve a groove to be formed in the middle of the blades 78 and that bending back these outer portions prevents blade abrasion from the comminuted particles which are being conducted and pushed through fan housing 16 and out of outlet opening 42.

Secondly, ring means 66 includes a rounded shoulder 67 which mateably is positioned against rounded edge 69 of blades 78 formed between horizontal edge 114 and vertical edge 110. Rounded shoulder 69 prevents particle build-up between blades 78 and enhances air flow throughout comminutor 10.

Thirdly, the angle of lower blade portion 139 with respect to plane 146 (shown by dotted lines in FIGS. 3, 4, 7) intersecting the lowermost edges 116 of blades 78 is crucial to operation of the invention. In particular, by referring to FIG. 7, it can be seen that carbide tip 140 along the back edge of lowermost edge 116 of lower blade portion 134 is aligned with lower blade portion 134. The preferred angle (identified by reference numeral 144) between lower blade portion and plane 146 is between 35° and 45°, and optimally, between 37° and 42°.

In addition to the structure of blades 78, the operation of the invention is dependent upon other factors. The number and spacing of blades 78 and the speed at which fan 14 is rotated all are critical factors in the operation of comminutor 10. In the preferred embodiment, eleven blades 78 are utilized. The spacing of blades 78 is controlled by the following ratio:

$$\frac{\text{Blade gap area}}{\text{Total inlet area}}$$

where blade gap area and total inlet area are both measured in plane 146 defined by lowermost edges 116 of lower blade portions 134 of blades 78, or equivalently, defined by the lowermost surface of journal means 76 or ring means 66. Blade gap area is thus the area between each blade 78 shown by the dotted line 148 in FIG. 5. It is preferred that the ratio be between 1:15 and 1:25 and in particular, between 1:18 and 1:23.

The speed of fan 14 is variable, but for a desired particle size can be determined by utilizing fan laws such as are known in the art. Fan 14 is generally rotated at a tip speed of from 200 to 300 feet/second. Motor 22 generally must produce a rotation of axle 18 of from 7,000 to 10,000 r.p.m. For example, if fan 14 was 12 inches in diameter, had 11 blades each being $2\frac{3}{4}$ inches tall, and the fan was rotated at 7250 rpms resulting in the lowermost edges 116 traveling at 269 feet per second, the air volume of fan 14 would be approximately 1000 acfm (average cubic feet/minute). On the other hand, a 20 inch fan with a blade height of $1\frac{3}{4}$ inches and having 16 blades run at 4000 rpms producing a tip speed of 279 feet per second would produce approximately the same air volume.

It is to be understood that the combination of the angle of incidence, the number, and the spacing of blades 78, combined with the tip speed of lowermost edges 116, produces the action which results in the efficient and uniform comminution of comminutor 10. This combination produces a pulsating turbulence zone in the rotational impact area in the interior of annular section 26 directly below lowermost edges 116. A pulsing or wave-like air pressure effect is created tending to alternately draw and push away the material being comminuted, thereby maintaining the material in the pulsating turbulence zone for a longer period of time for particle-to-particle attrition to take place.

While the combination of ring means 66 and journal means 76 creates an enhanced air lock and air flow through the device, the angle of lowermost edges 116 along with the thickened hammer edge created by carbide tips 140 and the spacing and number of blades 78 is primarily responsible for the pulsating turbulence.

FIG. 5 shows clearly how the blades 78 are attached to sleeve 94 at a location along sleeve 94 which is forward from an imaginery line drawn between the center of sleeve 94 and the outer edge 130 of blade 78. Therefore, outer edge 130 trails inner end 100 for each blade 78. FIG. 5 also shows how upper blade portions 130 of blades 78 extend past the opening defined by journal means 76.

The operation of the comminutor 10 is as generally described previously. In the case of the apparatus shown in FIG. 1, lump coal from bin 48 is, in a controlled manner, introduced into input conduit 24. It is to be noted that unwanted material such as pig or tramp iron or metal chicks are immediately disposed of out of the open bottom of tubular section 32. The suction of fan 14 pulls most of the material to be comminuted into frusto-conical section 26. The material slows down and assumes a centrifugal motion because of the larger inside diameter of frusto-conical section 30. The material reaches a maximum velocity as it is pulled into annular section 26 directly below fan 14 and it is held there by the force generated, as explained by fan laws. The material is then comminuted to a reduced size between 0 and $\frac{1}{4}$ inch depending on the pressure being produced (which is negative in front of the fan). When it has been reduced to the minimum size for the corresponding pressure, the material will be light enough that it rises to the fan where they are then sent out of outlet opening 42 into classifier 54, wherein the material is sorted, either to be reintroduced into the comminuter or channeled directly into the kiln 12.

It is to be noted that blades 78 extend downwardly to just above the bottom of journal means 76. The portion of annular section 26 of input conduit 24 comprises what shall be known as the rotational impact area. It is at this area which the pulsating turbulence zone is created and where the smaller particles of the material actually assist in breaking up the larger particles. Therefore, the materials are held at this location until a uniform-in-size particle is created, at which time it is lifted into the fan housing and then moved out by the positive pressure on the back side of the fan.

The included preferred embodiment is given by way of example only, and not by way of limitation to the invention, which is solely described by the claims herein. Variations obvious to one skilled in the art will be included within the invention defined by the claims. It can be seen that the invention achieves at least all of its stated objectives.

It is to be understood that the interior of fan housing 116 could include a ceramic lining 41 or blades 78 of fan 14 could be coated with a material such as, for example, ceramic tiles, a tungsten carbide sheet, or a rubber lining to reduce wear. A window could be added to input conduit 24 for viewing of the comminution and access to the interior of input conduit 24.

It is to be understood that dynamics of the rotational impact area throughout the comminutor 10 can be changed by altering the fan blade angle and the blade spacing or gap area to inlet area ratio. Similarly, by altering the dimensions of the frustoconical section 30 and annular section 26 of input conduit 24, the size of the comminuted particles can be altered. Further, a damper could be inserted which could be actuated at the point of impact of the fan which would thus change the air flow and pressure, thus altering the comminuting properties of the invention.

It is also to be understood that comminuted materials leaving outlet conduit 44 could be rechanneled into input conduit 24 and be further reduced in size.

It is to be further understood that the present invention can be applied to other areas such as fine particle technology, biotechnology, heterogeneous combustion, multi-phase and turbulent heat transfer, pollution control, feedback control and explosion prevention. Additional industrial applications include boiler and dryer combustion chambers, asphalt/lime/cement/gypsum kiln combustion chambers, incinerator combustion chambers and ammonia reformer combustion chambers.

What is claimed is:

1. A method of pneumatically comminuting materials, said method comprising the steps of: providing a device which has a housing in which a fan which has a rotational axis and is mounted on a vertical axis and which is driven by a motor means, each blade of said fan having a lower portion of one length and an upper portion which has a length greater than said one length, wherein said lengths are measured radially from the rotational axis of said fan and said upper and lower portions of each of said blades are joined to form a continuous fan structure, said housing has a conduit defining a rotational impact zone with an inlet opening aligned with the rotational axis of said fan, said inlet opening bas a diameter which is larger than twice said one length, creating an air lock by providing a sealing ring secured in said inlet opening to said housing, said sealing ring having at least first and second annular parallel spaced apart flanges extending inwardly therefrom which mateably retain said fan in a centered position in said housing supplying the material which is to be comminuted into said rotational impact zone of said housing, rotating said fan, thereby creating section and rotational turbulance in said housing in said rotational impact zone, thereby causing particle to particle collisions in said rotational impact zone, thereby decreasing the size of said particles to a predetermined size, and withdrawing said particles of predetermined size from said rotational impact zone through said inlet opening.

* * * * *